United States Patent [19]

Mills

[11] 4,399,785

[45] Aug. 23, 1983

[54] ENGINE PROTECTIVE DEVICE RESPONSIVE TO LOW OIL PRESSURE

[75] Inventor: J. T. Mills, Houston, Tex.

[73] Assignee: Sentinel Manufacturing Company, Incorporated, Denver, Colo.

[21] Appl. No.: 296,193

[22] Filed: Aug. 25, 1981

[51] Int. Cl.[3] ..... F02B 77/08

[52] U.S. Cl. ..... 123/198 DB; 123/198 D; 123/196 S

[58] Field of Search ..... 123/198 D, 198 DB, 196 S

[56] References Cited

U.S. PATENT DOCUMENTS

| | | | |
|---|---|---|---|
| 3,148,671 | 9/1964 | Bottorff et al. | 123/198 DB |
| 3,153,403 | 10/1964 | Dobbs | 123/198 DB |
| 3,202,143 | 8/1965 | Goodwin | 123/41.15 |
| 3,202,161 | 8/1965 | Richards | 123/198 D |
| 3,492,983 | 2/1970 | Vipperman | 123/198 DB |
| 3,523,521 | 8/1970 | Goodwin | 123/198 DB |
| 3,533,390 | 10/1970 | Goodwin | 123/198 DB |
| 3,590,798 | 7/1971 | Goodwin | 123/198 D |
| 3,626,920 | 12/1971 | Maher | 123/198 DB |
| 3,877,455 | 10/1970 | Goodwin | 123/198 D |
| 4,067,348 | 1/1978 | Davis | 123/198 DB |
| 4,080,946 | 3/1978 | Cunningham | 123/198 DB |
| 4,106,468 | 8/1978 | Davis | 123/198 DB |
| 4,117,822 | 10/1978 | Mills | 123/198 DB |
| 4,202,513 | 5/1980 | Bilbrey et al. | 123/198 DB |
| 4,329,954 | 5/1982 | Dobbs | 123/198 DB |
| 4,338,896 | 7/1982 | Papasideris | 123/198 DB |

FOREIGN PATENT DOCUMENTS

| | | |
|---|---|---|
| 560498 | 4/1944 | United Kingdom . |
| 1416473 | 12/1975 | United Kingdom . |

*Primary Examiner*—Ira S. Lazarus

*Attorney, Agent, or Firm*—Kerkam, Stowell, Kondracki & Clarke

[57] ABSTRACT

An engine protective device that is responsive to low oil pressure to cut off or limit fuel flow to avoid or minimize the chance of engine damage. A spring-biased elongate main valve member includes an axial bore and an override spring-biased ball valve to selectively allow fuel flow through said axial bore. A remote override function is realized by use of a bypass valve controlled by a pneumatic or electrical switch. An override lock prevents a mechanical, local (i.e., not remote) override from being changed from an override position back to a normal or off position in the event of insufficient oil pressure.

30 Claims, 8 Drawing Figures

MAIN VALVE CLOSED
OVERRIDE VALVE OPEN

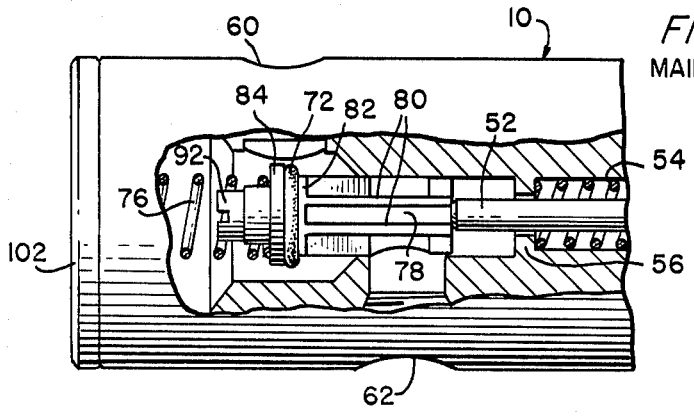
FIG. 4.
MAIN VALVE OPEN
FIG. 5.
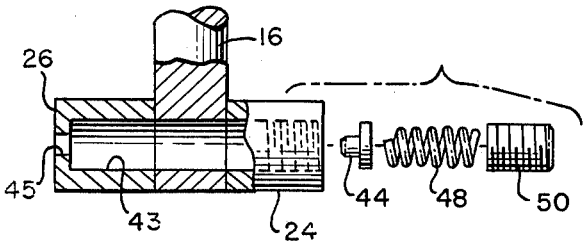
FIG. 7.
OVERRIDE VALVE CLOSED
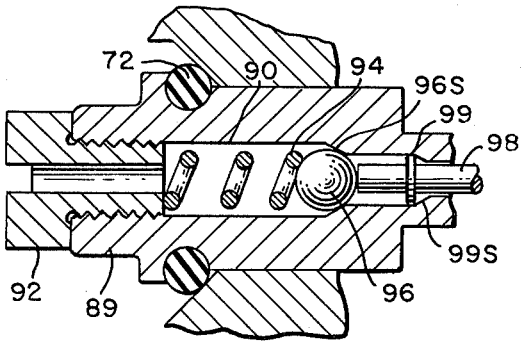
FIG. 6.
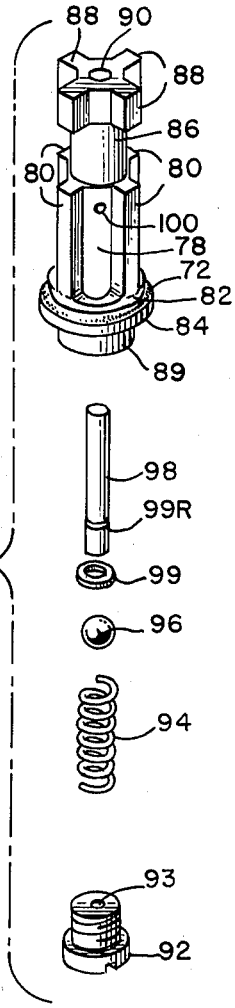

ENGINE PROTECTIVE DEVICE RESPONSIVE TO LOW OIL PRESSURE

TECHNICAL FIELD

This invention relates to safety devices for controlling the flow of fuel to internal combustion engines so as to protect an engine against damage due to insufficient oil pressure in the lubricating system thereof.

BACKGROUND OF PRIOR ART

There are in the prior art a number of engine protective devices which shut off or greatly reduce the flow of fuel to the engine in the event of inadequate lubricating oil pressure. The following Patents assigned to the Assignee of the present invention, and hereby incorporated by reference, disclose such prior art devices:

| U.S. Pat. No. | Inventor | Dated |
|---|---|---|
| 3,202,143 | Goodwin | Aug. 24, 1965 |
| 3,523,521 | Goodwin | Aug. 11, 1970 |
| 3,590,798 | Goodwin | Jul. 6, 1971 |
| 4,117,822 | Mills | Oct. 3, 1978 |

The device of U.S. Pat. No. 3,202,143 is a full fuel shut off valve effecting an automatic full shut down of the engine when the oil pressure drops below a predetermined value or the engine overheats. This device also includes a manually operable override which, when operated, will allow sufficient fuel to reach the engine to produce maximum power and speed even though the engine pressure has dropped below normal, or the engine has overheated, with possible consequent damage to the engine.

U.S. Pat. No. 3,523,521 discloses an engine safety device responsive to abnormal oil pressure conditions. The device includes means for varying the oil pressure level at which the fuel valve is shut off dependent on variations in the pressure of the fuel being supplied to the engine.

U.S. Pat. No. 3,590,798 also discloses an engine safety device responsive to abnormal oil pressure and coolant temperature conditions. However, unlike the two patented inventions discussed immediately above, this device is not a full fuel shut off effecting a full shut down of the engine. Instead, it is an automatic engine decelerating or detorquing valve by virtue of a built in fuel bypass which continues to supply the engine with a restricted quantity of fuel after the main fuel valve is closed. It also includes a manually operated override which, when operated, permits operation of the engine at maximum power and speed in like fashion to the above-described device of U.S. Pat. No. 3,202,143.

U.S. Pat. No. 4,117,822 discloses a safety device which effects a full shutdown of the engine when abnormally low oil pressure conditions arise. A manually operated override is included whereby a restricted amount of fuel sufficient only to run the engine at a reduced power and at reduced speed is supplied to the engine.

Although the devices of the prior art have been quite useful in preventing various engine damage, they have been subject to a number of undesirable limitations.

One limitation of the prior art devices, is the inability of the engine owner to determine whether the engine operator has overriden the fuel shut off valve. In particular, the prior art devices lack a means whereby the engine owner can determine whether the operator has overriden the emergency shut down. For these prior art devices, the operator may run the engine for long periods of time after actuating the override option, thereby causing severe damage to the engine. After such excessive engine damage has been caused, an unscrupulous operator may simply return the override control knob to the run position and deny having actuated the override. Due to the high cost of diesel engine repairs, engine owners are most desirous of minimizing override abuse by the operators after an emergency shut down.

A further problem with the prior art devices is the need to obtain access to the engine in order to override the engine protective devices shut off of the fuel flow. For certain engines it may be necessary to actuate the override for starting purposes because the fuel downstream from the fuel valve is not adequate to keep the engine going long enough to build up the oil pressure sufficiently to open the fuel valve. It is most inconvenient to have to obtain access to the engine to actuate the override for starting purposes.

A further deficiency in the prior art devices is the inability to conveniently and securely change from a detorque mode of operation (wherein failure of oil pressure causes a restricted amount of fuel flow) to a shut down mode of operation (wherein loss of oil pressure causes complete fuel cut off). Although the above-discussed U.S. Pat. No. 3,590,798 does disclose a device which may be changed from a detorque mode to a full shut down mode this change of modes may be accomplished simply by adjusting an externally accessible set screw 106. Accordingly, the operator of the engine may use such a set screw to defeat the engine owners command that the device be operated in the full shut down mode.

Although the above-mentioned U.S. Pat. No. 4,117,822 discloses a engine protective device with a restricted override, the restricted override has required mechanisms substantially different from the handle 50 and the cam 43 of such patents as U.S. Pat. Nos. 3,202,143 and 3,590,798. It would be most useful if an arrangement could be found, wherein a handle and cam such as in U.S. Pat. Nos. 3,202,143 and 3,590,798 controlled the operation of a restricted override.

BRIEF SUMMARY OF THE INVENTION

It is an object of the present invention to provide an override lock whereby an owner of an engine can tell whether the operator of the engine has activated the override function.

A further object of the present invention is to provide a remotely actuated override function for a fuel cut off device.

A further object of the present invention is to provide an engine safety device having options whereby loss of oil pressure may selectively cause either engine shut down or limited torque.

A still further object of the present invention is to provide a restricted fuel manual override wherein the same push rod used as a main valve operator is activated by a handle and cam arrangement in order to provide a restricted fuel manual override.

These and other objects which will be apparent as the description proceeds are realized by an apparatus for controlling the flow of fuel in a fuel supply line in a internal combustion engine in response to pressure in the lubricating system, comprising: a body having a main fuel passageway therein, a fuel inlet port and a fuel outlet port, each port communicating with said passageway and adapted to be connected to the fuel supply line of an internal combustion engine, a lubricant sensor for sensing the pressure in the engine lubricating system, a main valve in the main fuel passageway for controlling the normal flow of fuel between the fuel inlet port and the fuel outlet port, the main valve closing when the lubricant pressure sensor indicates that the pressure in the lubricating sensor system is below a predetermined valve P1, a main valve operator for maintaining the main valve in an open position as long as the lubricant pressure sensor indicates that the pressure in the engine lubricating system is above the predetermined valve P1. In order to realize the remotely actuated override function, the present invention further includes a bypass fuel passageway in the body, bypassing that portion of the main fuel passageway controlled by the main valve to allow a predetermined restricted amount of fuel from the fuel inlet port to the fuel outlet port, a normally bypassed valve selectively blocking the bypass fuel passageway, and a manually operable bypass valve actuated remote from the main body and connected to the main body by a control line. The present invention includes embodiments for both electrically and pneumatically activated remote override functions. In order to realize the override lock, the present invention further includes a first override actuator selectively disposable in an offstate and an override state, said override state allowing fuel flow in the fuel supply line of the engine even if the pressure in the engine lubricating system is below the predetermined value P1 and an override lock preventing the changing of the first override actuator from the override state to the offstate if the pressure in the engine's lubricating system is below a predetermined value P2. In the preferred embodiment of the present invention, the main valve includes an elongated main valve member which is spring biased by a main spring to be normally closed, the elongated main valve member including an axial bore therein, the axially bore having an inlet communication with the fuel inlet port and an outlet in communication with the fuel outlet port whereby fuel may flow through the axially bore from the fuel inlet port to the fuel outlet port, and a main valve operator for maintaining the main valve in an open position as long as a lubricant main sensor indicates that the pressure in the engine's lubricating system is above the predetermined valve P1.

BRIEF DESCRIPTION OF THE DRAWINGS

These and other features of the present invention and the advantages will be readily apparent to those having ordinary skill in the art and the invention will be more easily understood from the following detailed description of the preferred embodiments of the present invention taken in conjunction with the accompanying drawings wherein like reference characters represent like parts throughout several views.

FIG. 4 is a partial cross-section in the same plane as FIG. 3 with the main valve in the open position.

FIG. 5 is a side view of the cam of the present invention.

FIG. 6 is an exploded perspective of several of the parts of the main valve of the present invention.

FIG. 7 is an enlarged cross section of one end of the main valve member of the present invention.

DETAILED DESCRIPTION OF THE INVENTION

Figure 1:
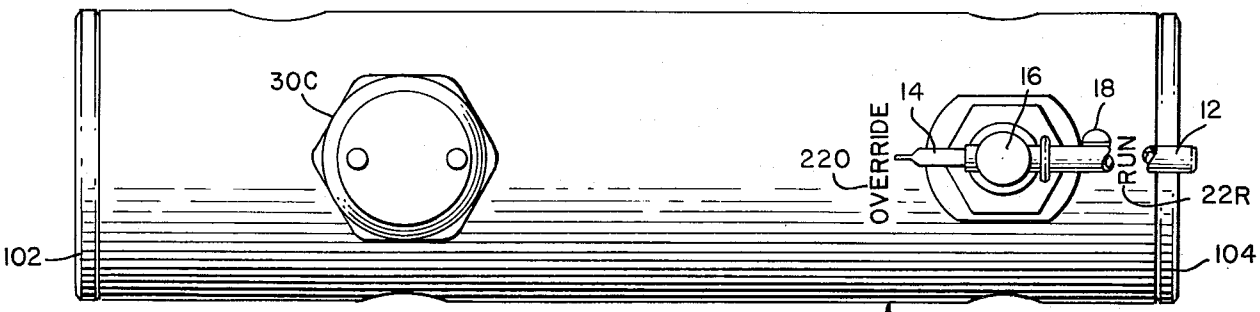
FIG. 1 is a top view of the present invention.

Referring now to FIG. 1, there is shown a top view of the present invention. Specifically, body 10 is generally cylindrical and includes at one end an operating handle 12 which turns a shaft 16 and associated limit pin 14. In addition to indicating whether the manual override is in an override state or a run state by virtue of the indicia 22O or 22R, limit pin 14 cooperates with stop pin 18 to prevent operating handle 12 and associated shaft 16 from turning more than 180° as described in more detail in U.S. Pat. No. 3,202,143. A remote override cap 30C, the details of which will be discussed later with reference to FIG. 5, is also shown in FIG. 1.

Figure 2:
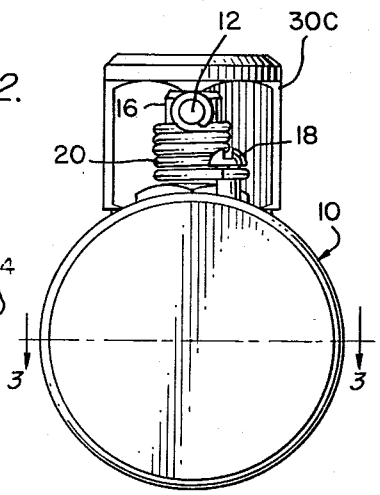
FIG. 2 is an end view of the present invention.

FIG. 2 is an end view showing the body 10, operating handle 12, shaft 16, limit pin 18 and remote override assembly. Torsion spring 20 tends to rotate operating handle 12, limit pin 14, and associated shaft 16 in a counterclockwise direction (relative to FIG. 1), thereby tending to maintain limit pin 14 in the run position.

Figure 3:
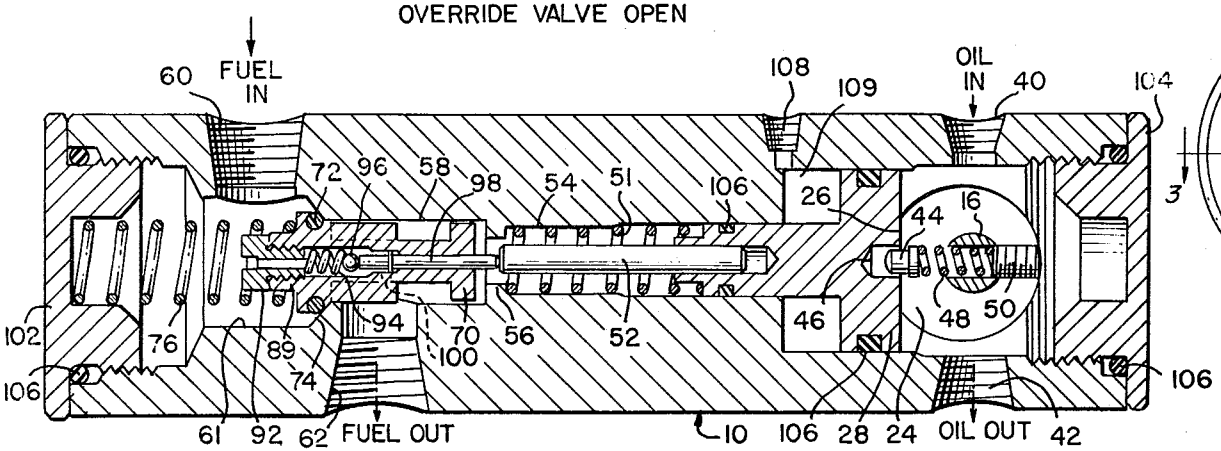
FIG. 3 is a cross-section taken along lines 3—3 of FIG. 2 and showing the main valve of the present invention in a closed position.

FIG. 3 shows a cross sectional view along lines 3—3 of FIG. 2. Shaft 16 connects to an eccentric cam 24 having a flat 26 on one side thereof. Cam 24 functions as an override actuator by flat 26 displacing piston 28. The cam 24 will be in an override state when flat 26 is against piston 28 and on off or run state when cam 24 has flat 26 180° away from piston 28. Spring biased piston 28 serves as an lubricant pressure sensor to sense the oil pressure of the engine by way of oil inlet port 40 and oil outlet port 42. With the exception of the remote override assembly 30, those parts of the present invention discussed already operate in the same manner as the corresponding parts in the above-identified patents. When operating handle 12 is turned clockwise to be in the position in FIG. 1, cam 24 will raise spring biased piston 28 to effectuate an override function. Flat side 26 of eccentric cam 24 will face piston 28 as shown in FIG. 3. However, once the lubricant oil pressure sufficiently overcomes the force of piston spring 51, cam 24 will be free to move relative to piston 28. Accordingly, torsion spring 20 will cause shaft 16 and attached cam 24 to rotate 180° from the position shown in FIG. 3. In other words, cam 24, shaft 16, limit pin 14, and operating handle 12 will automatically reset themselves into a run mode. This automatic resetting feature is highly desirable in that there is no further need for the engine protective device to cutoff or limit fuel flow once the oil level pressure has attained a safe value.

OVERIDE LOCK

Continuing to view FIG. 3, but also considering the side exploded view of FIG. 5, the override lock feature of the present invention will be presently discussed. It will be recalled briefly that an unscrupulous operator using one of the prior art engine protective devices may abuse the override mode. That is, such an operator may shift into an override mode, drive the engine for many miles, thereby causing extensive engine damage. Since the override feature is designed to simply allow an engine operator to get his truck or other machine to a safe place, this override abuse is especially troublesome to the engine owner. However, there was nothing in the prior art devices to prevent the unscruplous operator from simply shifting the handle 12 180° counter clockwise from the position shown in FIG. 1, after which the operator could simply deny having used the override mode.

In order to prevent such abuse of the override feature, whereby the operator could simply deny having used the override, the cam 24 of the present invention has been greatly improved from the prior art. Specifically, the cam 24 includes a bore 43 which extends across a diameter of cam 24 to about the middle of flat 26. At that end of bore 43, extending through flat 26, there is included an annular land 45. Shaft 16 which is secured to cam 24 includes a bore lined up with the bore 43. A spring plunger 44 is placed in bore 43 from that side of bore 43 opposite flat 26. Annular land 45 will hold spring plunger 44 in bore 43 against the urging of spring 48 which is placed behind spring plunger 44. A screw 50 may be used to close that side of bore 43 opposite side 26. Additionally, screw 50 may serve as a set screw to secure cam 24 to shaft 16.

With reference to FIG. 3, piston 28 is unlike the prior art pistons in that it includes a catch hole 46 which cooperates with spring plunger 44. As shown in FIG. 3, the cam 24 is in an override position whereby spring plunger 44 is disposed within catch hole 46 of spring piston 28. Accordingly, cam 24 is locked in the override position such that an unscrupulous engine operator is prevented from turning handle 12 back to the run position. At the same time, the automatic resetting function described in the prior art is still operational. Specifically, once the oil pressure has moved piston 28 to the left in FIG. 3, spring plunger 44 will clear catch hole 46, thereby allowing torsion spring 20 to automatically reset cam 24 in the same essential manner as the above discussed patents. In the absence of oil pressure sufficient to reset cam 24, handle 12 will be locked in the override position, thus indicating to the engine owner that the operator has resorted to the override.

MAIN VALVE AND OVERRIDE VALVE

Viewing FIGS. 3, 4 and 6, the main valve and override valve of the present invention will be discussed in detail. Push rod 52, serving as a main valve operator, is secured to piston 28 and extends axially along cylindrical bore 54. Coil compression spring 51 is disposed around push rod 52 between piston 28 and annular land 56, thereby biasing piston 28 to the right (as viewed in FIG. 3).

Colinear with bore 54 is a cylindrical main valve bore 58 which is separated from bore 54 by annular land 56. Main valve 58 is disposed partly between fuel inlet port 60 and associated fuel chamber 61 on one side and fuel outlet port 62 on the other side. Disposed in main valve bore 58 is an elongated main valve member 70 which is normally closed by virtue of O-ring 72 being biased against angular valve seat 74 by main valve spring 76. Main valve member 70 includes flutes or grooves 78 extending axially along generally cylindrical main valve member 70, each of these axial grooves 78 being between two adjacent radially projecting portions 80. The axial grooves and associated radial portions 80 extend from a disc shaped portion 82 to a cylindrical portion 86 (best shown in FIG. 6). Radially projecting portions 88 are colinear with corresponding projecting portions 80. Disposed between the disc 82 and an outer disc 84 is the O-ring 72. Outer disc 84 operates as an annular fluid blocking portion in conjunction with O-ring 72 and valve seat 74. The fuel inlet end of main valve member 70 includes a screw accepting head portion 89 which is disposed within fuel inlet chamber 61. An axial bore 90 extends along the axis of main valve 70.

The override valve parts which are generally within main valve member 70 will presently be discussed with reference to FIG. 3 and FIG. 6 and FIG. 7 which shows on enlarged partial view in cross section of the parts inside one end of valve member 70. An override push rod 98 is disposed within axial bore 90 and extends out of main valve 70 to contact push rod 52. Touching the opposite end of the override push rod 98 is a override ball valve 96 which is biased towards 98 by override spring 94. Push rod 98 is secured against being pushed out of the end of main valve member 70 by cooperation between stop ring 99 on override push rod 98 at annular recess 99R and the inwardly projecting annular stop 99S on bore 58. Screw 92 with axial orifice 93 (colinear with axial bore 90) is threadenly engaged to head portion 89 of main valve member 70, whereby override spring 94 override ball valve 96, and override push rod 98 are secured within bore 90.

The operation of the main valve member 70 and associated components will presently be discussed with reference to FIGS. 3, 4, 6 and 7 when operating handle 12 is disposed in the normal run mode. The absence of sufficient oil pressure acting on lubricant pressure sensing spring biased piston 28 will allow main valve spring 76 to bias main valve member 70 such that O-ring 72 is seated against main valve seat 74 as shown in FIG. 3. This cuts off any fuel flow from fuel inlet port 60 to fuel outlet port 62 by way of the main fuel passageway including fuel chamber 61 and that portion of bore 58 to the left (FIG. 3) fuel outlet port 62. In addition to the main valve being closed in FIG. 3, the override valve 96 will be closed as shown in FIG. 7 as long as operating handle 12 is not moved from the run position. In this run position, the flat 26 of cam 24 will be 180° removed from piston 28. Override push rod 98 will be in its furthest right position as shown in FIG. 7 with annular stop ring 99 disposed next to associated inwardly projecting angular stops 99S on bore 90. Accordingly, ball valve 96 will be biased by override or ball valve spring 94 to seat against annular ball valve seat 96S. When ball valve 96 is seated against ball valve seat 96S, no fuel may flow from fuel inlet port 60 to fuel outlet port 62 by way of axial orifice 93 (in screw 92), axial bore 90 and restricted outlet ports 100, a plurality of which are disposed within the axial grooves 78 of main valve member 70 (see especially FIG. 6). The restricted outlet ports 100 communicate with that portion of bore 90 downstream from ball 96. Accordingly, in the valve position shown in FIG. 7, fuel will be completely cut off from the engine.

It will thus be seen that the main valve will be closed when lubricant pressure sensing piston 28 indicates that the oil pressure is below a predetermined value P1. Push rod 52 serves as a main valve operator which maintains the maim valve open as long as the oil pressure on the piston is above P1. Momentarily referring back to the override lock, it should be appreciated that spring plunger 44 locks cam 24 until oil pressure displaces piston 28 sufficiently for plunger 28 to clear hole 46. This would occur at pressure value P2 which is not necessarily the same value as P1, although it will preferably be quite close.

In order to override the engine cutoff feature by allowing a restricted amount of fuel to flow to the engine, the override handle 12 will be rotated 180° clockwise so as to be in a position shown in FIG. 1. Upon this rotation cam 24 will also rotate 180° such that flat 26 will now be disposed of in contact with the face of piston 28 as shown in FIG. 3. As cam 24 is rotated, piston 28 will ride to the left (view of FIG. 3) such that push rod 52 will displace override push rod 98 to the left. The displacement of override push rod 98 to the left will cause ball valve 96 to be displaced to the left and away from ball valve seat 96S. Accordingly, a small or restricted amount of fuel may now flow from fuel inlet port 60 to fuel outlet port 62 by way of axial orifice 93, axial bore 90, and restricted fuel outlet ports 100. At the same time, the displacement in piston 28 caused by rotation of cam 24 will be insufficient to cause push rod 52 to displace leftwardly main valve member 70. Thus, O-ring 72 will remain seated against main valve seat 74 as shown in FIG. 3.

As is discussed in detail above, the spring plunger 44 will catch onto catch hole 46 in piston 28, whereby the engine operator will not be able to rotate cam 24, shaft 16 and attached handle 12 back to the run position. However, upon the correction of the insufficient oil pressure, piston 28 will be displaced further leftwardly from the position shown in FIG. 3 whereby torsion spring 20 will automatically reset manual override handle 12. Additionally, the displacement leftwards of piston 28 will cause push rod 52 to further compress spring 94 using up the play in override push rod 98 such that push rod 52 is now in contact with the end of valve member 70. Accordingly, valve member 70 will be displaced leftward, the main valve opening by virtue of O-ring 72 being unseated from valve seat 74 as shown in FIG. 4. Fuel may then proceed from fuel inlet port 60 to fuel outlet port 62 by way of flutes or axial grooves 78 in main valve 70, the main valve being disposed in an open position for normal engine operation.

In addition to being particularly advantageous in using push rod 52 and piston 28 to open both the main valve and the override valve, the present arrangement is especially advantageous in providing the engine owner with the option of using a full engine cutoff capability or a detorque upon inadequate oil pressure. Specifically, the arrangement shown in FIG. 3 may be easily converted into a detorque safety device by first unthreading end cap 102. Next, screw 92 may be removed from main valve member 70. Override push rod 98, ball valve 96 and spring 94 may then be removed from axial bore 90 in main valve member 70. Screw 92 and fuel end cap 102 may then be threaded back into their previous positions with spring 76 biasing main valve member 70, main valve 70 will provide its usual main valve functions in addition to providing a detorque or restricted fuel flow by way of orifice 93, axial bore 90 and restricted fuel outlet ports 100.

Although the option of using the device in either a full cutoff or a detorque mode is somewhat similar to that shown in prior art U.S. Pat. No. 3,590,798, the present invention provides that option with saveguards not realizable in that prior art patent. Specifically, although the present invention provides for a convenient adaptation from a cutoff to a detorque operation, the adaptation is internal to main body 10. It is therefore less likely to be tampered with by an operator who wishes to overrule the directions of the engine owner.

Opposite fuel end cap 102 is an oil end cap 104 which threads to body 10. Additionally, O-ring gaskets 106 are disposed of in various locations within the safety device. A threaded hole 108 (FIG. 3) is used to accomodate a felt filter, allowing chamber 109 to "breath" as piston 28 rides back and forth.

REMOTE OVERRIDE FUNCTION

Figure 8:
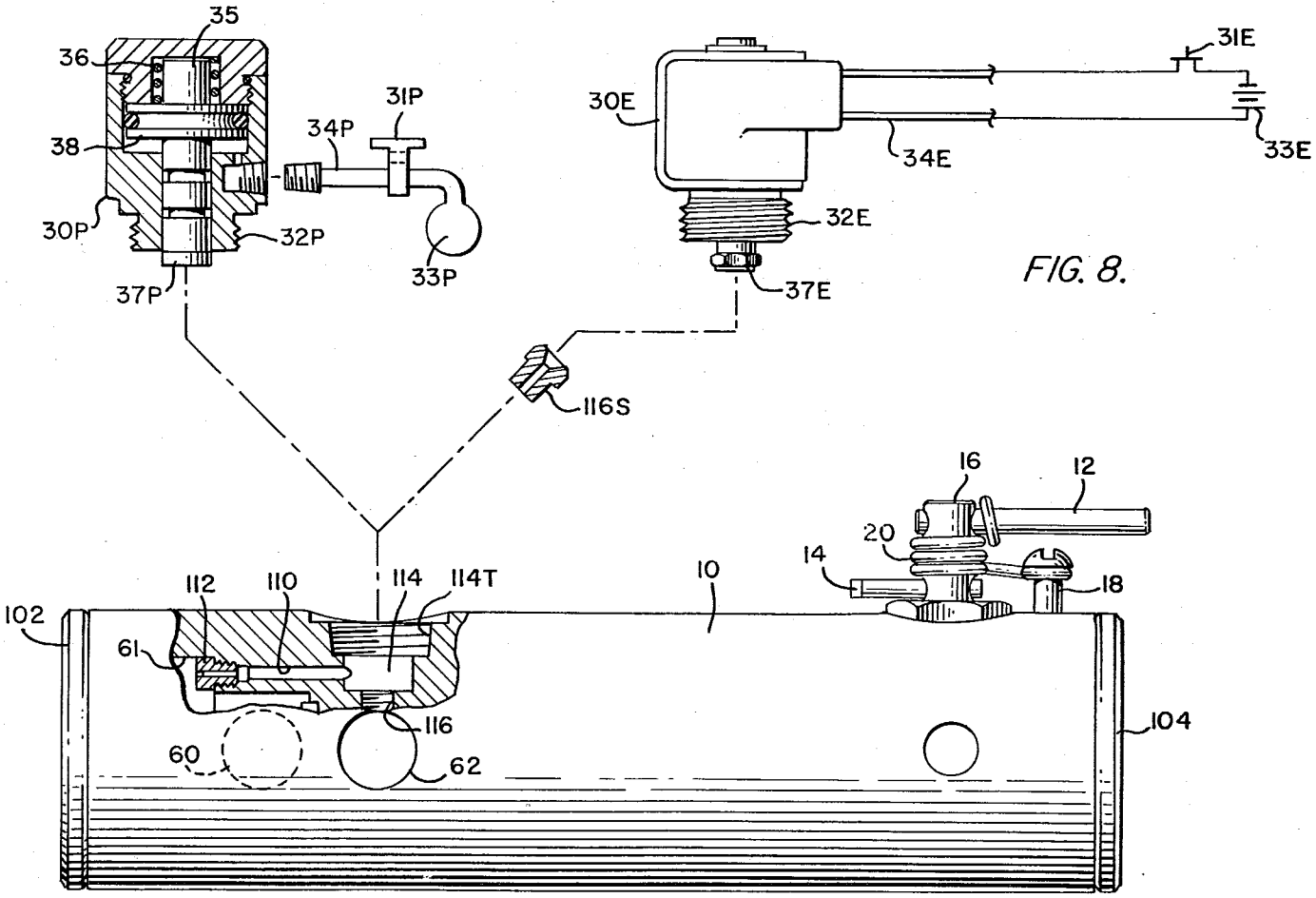
FIG. 8 is a side view of the present invention, shown in partial cross section to reveal the remote override feature, and showing both a pneumatic and electrical embodiments of a remotely actuated valve.

Referring now to FIG. 8, the remote override or bypass valve feature of the present invention will be discussed. Specifically, there is shown in FIG. 8 side view of main body 10 showing a partial cross section of a remotely actuated override portion. In particular fuel inlet chamber 61 is in communication with bypass fuel passageway 110 by way of an axial orifice in screw 112. Fuel bypass passageway 110 extends into a remote override chamber 114 having a threaded opening 116 extending into fuel outlet port 62 (shown in phantom in FIG. 8). Remote override chamber 114 includes a threaded mouth 114T for accomodating a remote override assembly.

Threads 32P on pneumatic override assembly 30P, functioning as a bypass valve, are adapted to engage the threads 114T of remote override chamber 114. A spring 36 normally biased on rod 35 and attached piston 38 downwardly such that valve portion 37P of rod 35 will normally close off any fuel flow which might otherwise go through port 16. However, upon the application of pneumatic pressure to pneumatic override assembly 30P by way of pneumatic control line 34P from pneumatic source 33P through momentary valve 31P, piston 38 and valve portion 37P will be displaced upwardly such that fuel may fully flow from bypass fuel passageway 110, through port 116, and into fuel outlet port 62. As shown in FIG. 8, the bypass fuel passageway 110 is separated from the main valve portion of the main fuel passageway by a portion of the body 10.

As an alternate embodiment, the override assembly bypass valve of the present invention may be realized by an electrical override assembly 30E having threads 32E to cooperate with threads 114T. Control line or lines 34E may extend from the electrical override assembly 30E to a remote electrical switch 31E. The electrical override assembly 30E, screw 116S is threaded into opening 116 to provide a proper valve seat. For electrical override assembly 30E may be realized by a conventional solenoid which selectively blocks and opens the orifice in screw 116S by valving portion 37E. Preferably, electrical override 37E is a solenoid valve of the normally closed type such that 37E will block fuel flow bypass fuel passageway 110 in the absence of an electrical signal on electric cable 34E.

The remote override assembly 30P and 30E is especially useful in starting an engine having the present safety device attached thereto. Turning back momentarily to FIG. 3, it will be apparent that main valve O-ring, 72 will be seated against valve seat 74 in the absence of sufficient oil pressure to properly displace piston 28. For many engines this does not pose a problem because there is sufficient fuel downstream of main valve member 70 to allow initial start up, whereupon oil pressure will quickly build up to open valve member 70. However, for some engines the oil pressure will not build up sufficiently quickly to properly open valve member 70. Accordingly, the use of a remotely actuated override function is especially useful for these engines.

In order to minimize the possibility of remote override abuse, the pneumatic valve override assembly 30P is preferably controlled by a panel mounted press-to-hold push button valve 31P. Likewise, the electrical solenoid valve override assembly 30E is preferably controlled by a panel mounted press to hold pushbutton 31E. Accordingly, the remote override function will be realized only as long as the engine operator depresses the push to hold pushbutton, either electrical or pneumatic.

The body 10 of the present fuel controller is especially flexible in that the pneumatic override assembly 30P and the electrical override assembly 30E are completely interchangeable. For an engine starting by an air starter, the pneumatic override assembly 30P would be preferred. For an engine, wherein the common method of engine starting is accomplished by a battery or electrical starting, the present fuel controller will effectuate a remote override function by virtue of electrical override assembly 30E. If an engine owner initially equips his fuel controller for a pneumatic remotely actuated override function, he can easily convert to an electrical remotely actuated override function simply by substituting 30E for 30P. Likewise, an owner can easily change from an electrical remote override function to a pneumatic override function. Additionally, should the engine owner so desire, no remote override function need be provided. In particular, a cap plug 30C (shown in FIG. 1 and FIG. 2) may be threaded into chamber 114 instead of either of the override assemblies 30P and 30E. The cap plug 30C may simply provide a continuous block to the orifice in screw 116S, whereby bypass fuel passageway 110 is always closed.

The present invention causes the cutoff of fuel flow in response to an oil pressure drop. It is therefore useful in conjunction with devices which cause an oil pressure drop responsive to engine overheating, coolant loss, or other malfunctions. Such devices may, for example, be similar to those disclosed in U.S. Pat. No. 3,533,390, issued Oct. 13, 1975 and U.S. Pat. No. 3,877,455, issued Apr. 15, 1975, both invented by Joe E. Goodwin and assigned to the assignee of the present invention.

Although the present invention has been described in detail with respect to specific construction, arrangements, materials, these details for illustrative purposes only. Numerous modifications and adaptations will be readily apparent to those of ordinary skill in the art. Accordingly, the scope of the present invention will be determined by reference to the appended claims.

What is claimed is:

1. An apparatus for controlling the flow of fuel in a fuel supply line of an internal combustion engine in response to pressure in the engine's lubricating system, comprising:

(a) a body having a main fuel passageway therein;

(b) a fuel inlet port and a fuel outlet port, each port communicating with said passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1;

(e) a main valve operator for maintaining said main valve in an open position as long as the lubricant pressure sensor indicates that the pressure in the engine's lubricating system is above the predetermined value P1;

(f) a bypass fuel passageway in said body, bypassing that portion of said main fuel passageway controlled by said main valve, to allow a predetermined restricted amount of fuel from said fuel inlet port to said fuel outlet port;

(g) a normally closed bypass valve selectively blocking said bypass fuel passageway, and;

(h) a manually-operable bypass valve actuator remote from said main body and connected to said bypass valve by a control line and wherein said portion of said main fuel passageway controlled by said main valve is separated from said bypass fuel passageway by a portion of said main body and said bypass valve will close unless said manually-operable bypass valve actuator is continually actuated to hold said bypass valve open.

2. The apparatus of claim 1 wherein said main valve includes a main valve member which is spring-biased by a main valve spring to be normally closed and said lubricant pressure sensor includes a spring-biased piston operably connected to said main valve body by said main valve operator.

3. The apparatus of claim 2 wherein said main valve operator is a push rod, and further including a coil piston-spring coaxial to said push rod, said coil piston spring biasing said spring-biased piston.

4. The apparatus of claims 1 or 3 wherein said bypass valve is a solenoid valve, said bypass valve actuator is an electrical switch, and said control line is an electrical cable.

5. The apparatus of claims 1 or 3 wherein said bypass valve is a pneumatic valve, said control line is a pneumatic pressure line, and said bypass valve actuator is operative to supply pneumatic pressure to said pneumatic pressure line.

6. The apparatus of claims 1, 2 or 3 wherein said bypass valve is threadingly mounted to said main body.

7. The apparatus of claim 2 further including:

(a) an override actuator selectively disposable in an off state and an override state, said override state allowing fuel flow in the fuel supply line of the engine even if the pressure in the engine's lubricating system is below said predetermined value P1 and;

(b) an override lock preventing the changing of said override actuator from the override state to the off state if the pressure in the engine's lubricating system is below a predetermined value P2.

8. The apparatus of claim 7 wherein said first override actuator includes a cam operative to displace said spring-biased piston, and said override lock is a spring-biased plunger which secures said cam to said spring-biased piston.

9. The apparatus of claim 3 wherein said main valve member is an elongated member having an axial bore therein, said axial bore having an outlet in communication with said fuel outlet port whereby fuel may flow through said axial bore from said fuel inlet port to said fuel outlet port.

10. The apparatus of claim 9 further including a spring-biased ball valve inside of said elongate member, said spring-biased ball valve selectively blocking fuel flow in said axial bore.

11. Apparatus for controlling the flow of fuel in a fuel supply line of an engine in response to pressure in the engine's lubricating system, comprising:

(a) a fuel inlet port,
(b) a fuel outlet port,
(c) a main valve for selectively blocking the flow of fuel supply line of an engine when said fuel inlet port and said fuel outlet port are connected in said fuel supply line,
(d) a lubricant pressure sensor for sensing the pressure in the engine's lubricating system,
(e) a main valve operator for opening said valve whenever the lubricant pressure sensor indicates that the pressure in the engine's lubricating system is above a predetermined value P1;
(f) an override actuator selectively disposable in an off state and an override state, said override state allowing fuel flow in the fuel supply line of the engine even if the pressure in the engine's lubricating system is below said predetermined value P1, and;
(g) an override lock preventing the changing of said first override actuator from the override state to the off state if the pressure in the engine's lubricating system is below a predetermined value P2.

12. The apparatus of claim 11 wherein said main valve includes a main valve member which is spring-biased by a main valve spring to be normally closed and said lubricant pressure sensor includes a spring-biased piston operably connected to said main valve body by said main valve operator.

13. The apparatus of claims 11 or 12 wherein said override lock comprises a spring-biased member.

14. The apparatus of claim 12 wherein said first override actuator includes a cam operative to displace said spring-biased piston, and said override lock is a spring-biased plunger which secures said cam to said spring-biased piston.

15. The apparatus of claim 14 wherein said spring-biased plunger is mounted to said cam and said spring-biased plunger locks onto a catch on said spring-biased piston.

16. The apparatus of claim 14 wherein said main valve operator is a push rod, said main valve member is an elongate member and further including a coil piston-spring coaxial to said push rod, said coil piston-spring biasing said spring-biased piston.

17. The apparatus of claim 16 wherein said elongate member includes an axial bore there, said axial bore having an inlet in communication with said fuel inlet port and an outlet in communication with said fuel outlet port whereby fuel may flow through said axial bore from said fuel inlet port to said fuel outlet port.

18. The apparatus of claim 17 further including a spring-biased ball valve inside of said elongate member, said spring-biased ball valve selectively blocking said axial bore.

19. The apparatus of claim 18 further including an override push rod in said axial bore, said override push rod operative to open said spring-biased ball valve when said override actuator is in said override state.

20. The apparatus of claim 11 wherein said override actuator is automatically reset from an override state to an off state if the pressure in the engine's lubricating system is above said predetermined value P2.

21. The apparatus of claim 12 further including:
(a) a bypass fuel passageway in said body, bypassing that portion of said main fuel passageway conrolled by said main valve to allow a predetermined restricted amount of fuel from said fuel inlet port to said fuel outlet port,
(b) a normally closed bypass valve selectively blocking said bypass fuel passageway, and
(c) a manually-operable bypass valve actuator remote from said main body and connected to said main body by a control line.

22. An apparatus for controlling the flow of fuel in a fuel supply line of an internal combustion engine in response to pressure in the engine's lubricating system, comprising:
(a) a body having a main fuel passageway therein;
(b) a fuel inlet port and a fuel outlet port, each port communicating with said passageway and adapted to be connected to the fuel supply line of an internal combustion engine,
(c) a lubricant pressure sensor for sensing the pressure in the engine's lubricating system,
(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1, said main valve includes an elongate main valve member which is spring-biased by a main valve spring to be normally closed, said elongated main valve member includes an axial bore therein, said axial bore having an inlet in communication with said fuel inlet port and an outlet in communication with said fuel outlet port whereby fuel may flow through said axial bore from said fuel inlet port to said fuel outlet port;
(e) a main valve operator for maintaining said main valve in an open position as long as the lubricant pressure sensor indicates that the pressure in the engine's lubricating system is above a predetermined value P1, and wherein said elongate main valve member includes an annular fluid blocking portion which is disposed in between said fuel inlet port and said fuel outlet port when said main valve is closed, and further comprising an override valve inside of said elongate member, an override spring biasing said override valve, said override valve selectively blocking said axial bore to selectively allow fuel flow through said axial bore.

23. The apparatus of claim 22 wherein said elongate main valve member includes a plurality of axial grooves disposed in between said fuel outlet port and said annular fluid blocking portion.

24. The apparatus of claim 23 wherein said override valve is a spring-biased ball valve.

25. The apparatus of claim 24 further including an override push rod in said axial bore, said override push rod operative to open said spring-biased ball valve when said override actuator is in said override state.

26. The apparatus of claim 25 wherein said lubricant pressure sensor comprises a spring-biased piston operably connected to said elongate main valve member by said main valve operator, said main valve operator is a main push rod, and further including a coil piston-spring coaxial to said main push rod, said coil piston spring biasing said spring-biased piston.

27. The apparatus of claim 26 further including:
(a) a bypass fuel passageway in said body, bypassing that portion of said main fuel passageway controlled by said main valve, to allow a predetermined restricted amount of fuel from said fuel inlet port to said fuel outlet port, (b) a normally closed bypass valve selectively blocking said bypass fuel passageway, and (c) a manually-operable bypass valve actuator remote from said main body and connected to said main body by a control line.

28. The apparatus of claim 27 wherein said bypass valve is a solenoid valve, said bypass valve actuator is an electrical switch, and said control line is an electrical cable.

29. The apparatus of claim 27 wherein said bypass valve is a pneumatic valve, said control line is a pneumatic pressure line, and said bypass valve actuator is operative to supply pneumatic pressure to said pneumatic pressure line.

30. The apparatus of claims 22 or 27 further including:

(a) an override actuator selectively disposable in an off state and an override state, said override state allowing fuel flow in the fuel supply line of the engine even if the pressure in the engine's lubricating system is below said predetermined value P1 and;

(b) an override lock preventing the changing of said override actuator from the override state to the off state if the pressure in the engine's lubricating system is below a predetermined value P2.

* * * * *